US008904934B1

(12) United States Patent
Scheid

(10) Patent No.: US 8,904,934 B1
(45) Date of Patent: Dec. 9, 2014

(54) SEGMENTED FLEXIBLE LINEAR SHAPED CHARGE

(75) Inventor: Eric Scheid, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 867 days.

(21) Appl. No.: 13/016,891

(22) Filed: Jan. 28, 2011

(51) Int. Cl.
*F42B 3/08* (2006.01)
*F42B 1/02* (2006.01)

(52) U.S. Cl.
CPC .... *F42B 1/02* (2013.01); *F42B 3/08* (2013.01)
USPC ..... 102/307; 102/331

(58) Field of Classification Search
CPC ..... F42B 1/02; F42B 1/028; F42B 1/032; F42B 3/08
USPC ..... 102/305, 306, 307, 308, 309, 310, 476, 102/331, 332; 175/4.6; 89/1.15
See application file for complete search history.

(56) References Cited

U.S. PATENT DOCUMENTS

| | | | | |
|---|---|---|---|---|
| 2,513,233 | A * | 6/1950 | Byers | 102/306 |
| 2,543,057 | A | 2/1951 | Porter | |
| 3,185,089 | A | 5/1965 | Parkhurst et al. | |
| 3,335,664 | A * | 8/1967 | Enzian | 102/307 |
| 3,374,737 | A * | 3/1968 | Pike | 102/275.5 |
| 3,855,929 | A | 12/1974 | Ridgeway | |
| 4,240,349 | A | 12/1980 | Lash | |
| 4,649,824 | A * | 3/1987 | Guay | 102/307 |
| 4,649,825 | A * | 3/1987 | Quick et al. | 102/307 |
| 4,693,181 | A | 9/1987 | Dadley et al. | |
| 4,815,384 | A * | 3/1989 | Ringel et al. | 102/307 |
| 5,196,648 | A * | 3/1993 | Jones | 102/307 |
| H1216 | H | 8/1993 | Vigil et al. | |
| 5,377,594 | A | 1/1995 | Alford | |
| 6,739,265 | B1 | 5/2004 | Badger et al. | |
| 7,536,956 | B2 * | 5/2009 | Sammons et al. | 102/476 |
| 8,146,503 | B2 * | 4/2012 | Murray et al. | 102/476 |
| 2006/0201373 | A1 | 9/2006 | Sammons et al. | |
| 2009/0301334 | A1 | 12/2009 | Murray et al. | |

FOREIGN PATENT DOCUMENTS

| | | |
|---|---|---|
| WO | WO 2004/048880 | 6/2004 |

* cited by examiner

*Primary Examiner* — James S Bergin
(74) *Attorney, Agent, or Firm* — Christopher A. Monsey

(57) ABSTRACT

A segmented flexible linear shaped charge for use with an explosive device. The segmented flexible linear shaped charge includes a flexible explosive core and a plurality of axially spaced housing segments having rigidity greater than that of the core.

23 Claims, 6 Drawing Sheets

SEGMENTED FLEXIBLE LINEAR SHAPED CHARGE

STATEMENT REGARDING FEDERALLY SPONSORED RESEARCH OR DEVELOPMENT

The invention described herein was made in the performance of official duties by an employee of the Department of the Navy and may be manufactured, used, licensed by or for the United States Government for any governmental purpose without payment of any royalties thereon.

BACKGROUND AND SUMMARY OF THE DISCLOSURE

The present invention relates generally to explosive devices, such as linear shaped charges and, more particularly, to a segmented flexible linear shaped charge.

Previous linear shaped charges have been used in various explosive and cutting applications. Specifically, linear shaped charges may be used for specialized cutting, such as when the use of cumbersome mechanical cutting equipment would not be practical or possible. For example, linear shaped charges may be effective for pipe-cutting applications, underwater mining operations, controlled demolition projects, and well drilling. Furthermore, linear shaped charges may add to the safety of the cutting operation because the operator of a linear shaped charge may detonate the charge remotely. The desired cutting application has typically dictated whether a rigid or a flexible linear shaped charge is required. For example, metal jacketed linear shaped charges are efficient but inflexible, making such linear shaped charges less desirable for some applications requiring contoured blast patterns. Metal jacketed linear shaped charges typically include an explosive core load of between 300 and 2,000 grains per foot but lose any inherent flexibility when the explosive load exceeds 2,000 grains per foot. Conversely, foam jacketed linear shaped charges are flexible but less efficient, requiring greater quantities of explosive material in order to achieve the effect of a similarly sized metal jacketed linear shaped charge. For example, cutting applications including steel having a thickness of at least 1.0 inch are typically the threshold at which the foam jacketed linear shaped charges are no longer effective. As such, there is a need for a flexible and efficient linear shaped charge.

The present disclosure relates to a segmented flexible linear shaped charge comprising a flexible explosive core extending axially along a longitudinal axis, and a plurality of axially spaced housing segments. Each of the housing segments has rigidity greater than that of the explosive core. The explosive core extends within the plurality of housing segments, and each housing segment includes an upper wall, a lower wall, and opposing side walls connected to the upper wall and the lower wall. Upon detonation of the explosive core, the lower walls of the housing segments and the explosive core are focused into a target.

According to another illustrative embodiment of the present disclosure, a segmented flexible linear shaped charge comprises a flexible explosive core extending axially along a longitudinal axis. The explosive core extends within a plurality of axially spaced, rigid housing segments. A coupler secures the housing segments to a target. A plurality of intermediate portions extends between opposing ends of adjacent housing segments. The segmented flexible linear shaped charge has at least three degrees of freedom, including rotation about the longitudinal axis of the core, rotation about a first transverse axis that extends perpendicular to the longitudinal axis, and rotation about a second transverse axis that extends perpendicular to the longitudinal axis and the first transverse axis.

An illustrative method of using a segmented flexible linear shaped charge includes the steps of providing a linear shaped charge having a flexible explosive core, and providing a plurality of housing segments supported by the explosive core, the housing segments in spaced relation to each other to provide a plurality of intermediate portions between opposing ends of adjacent housing segments. The method further includes the steps of cutting the core within at least one of the intermediate portions to a desired length, and shaping the flexible explosive core to follow a desired contour. Additionally, the method comprises the step of supporting the lower walls of the housing segments in proximity to a target.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
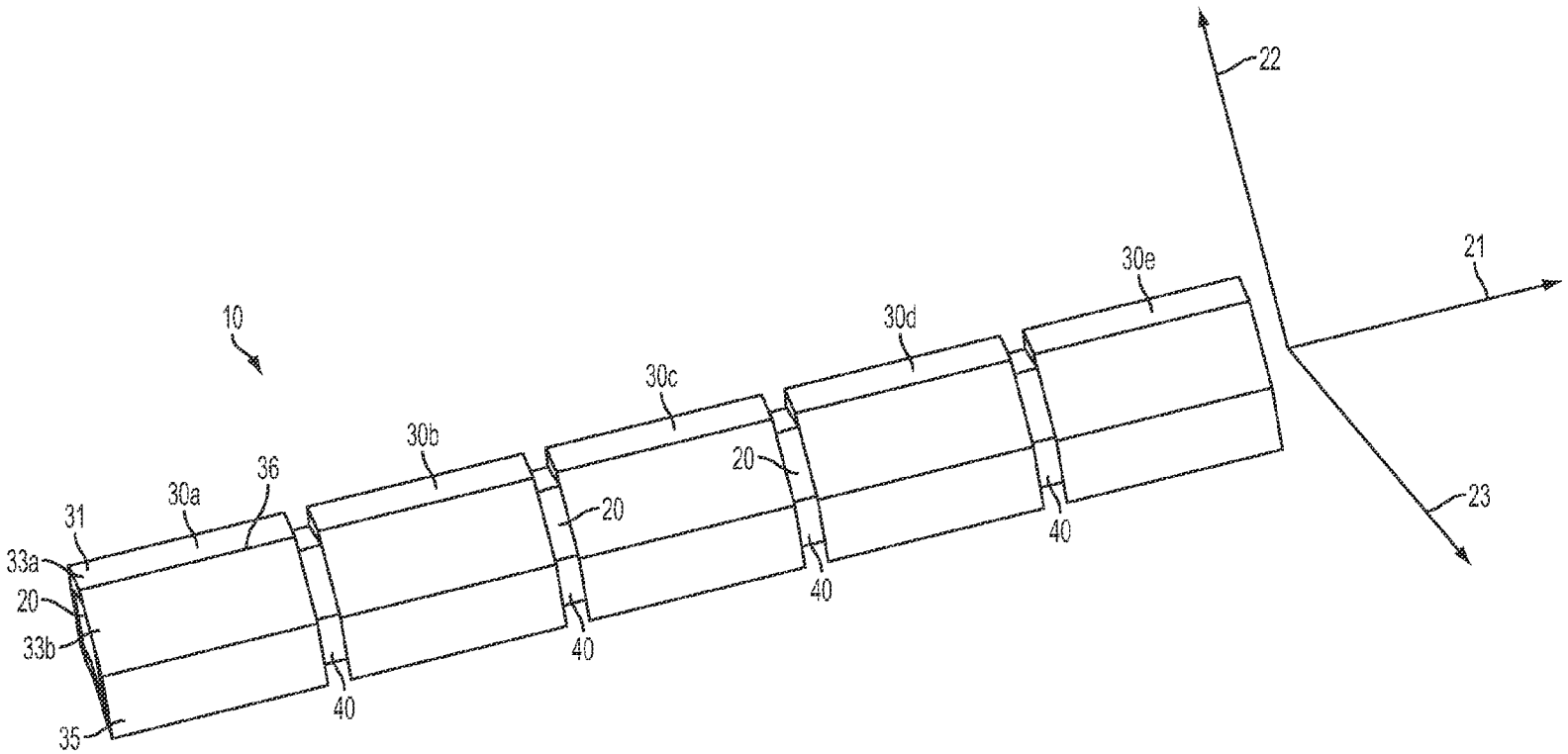
FIG. 1 is a front perspective view of a segmented flexible linear shaped charge in a linear configuration.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
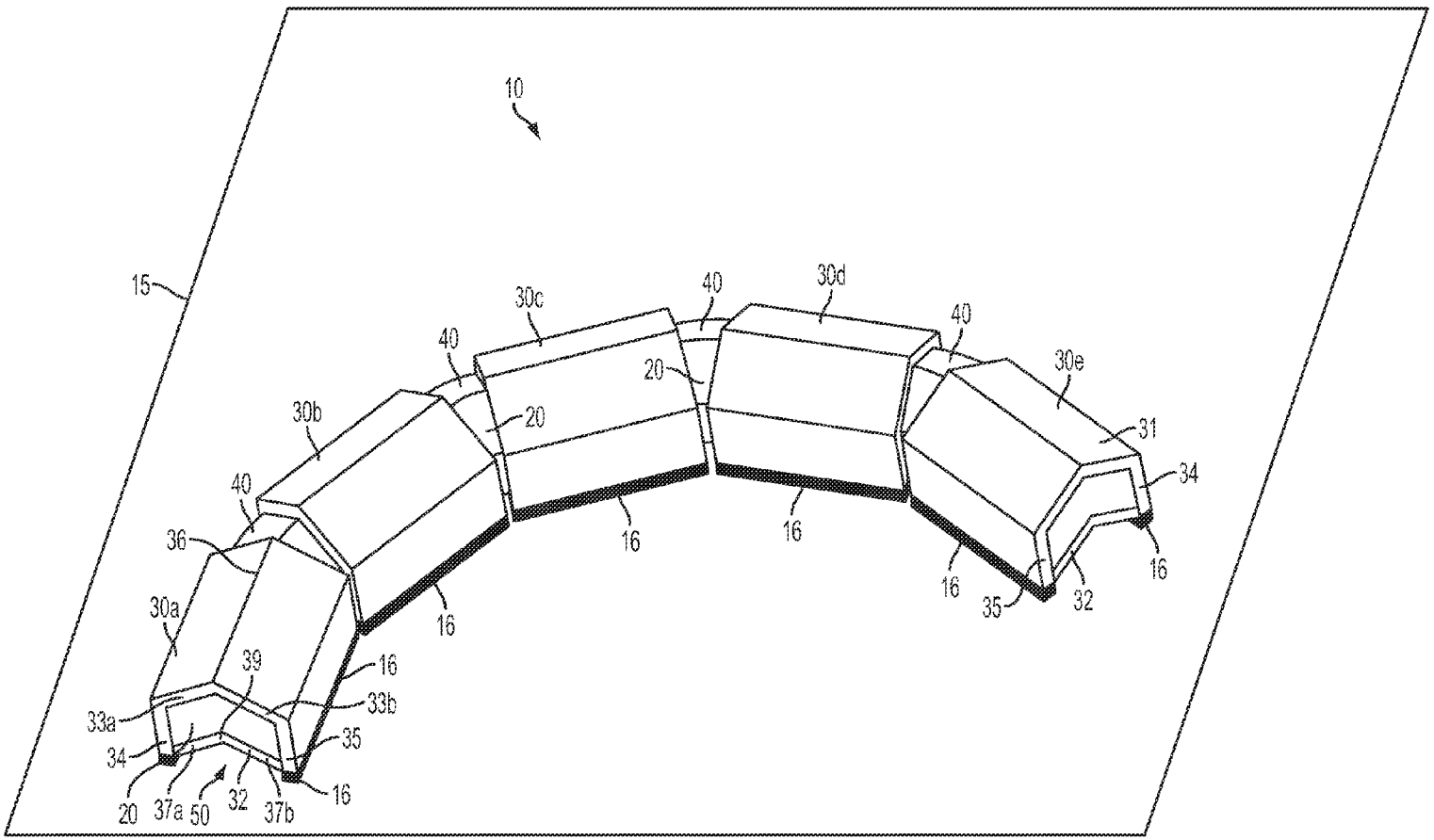
FIG. 2 is a front perspective view similar to FIG. 1 and showing the illustrative segmented flexible linear shaped charge in a contoured configuration and coupled to a target.

Referring initially to FIGS. 1 and 2, an illustrative segmented flexible linear shaped charge 10 is configured to be adjusted or moved between a linear position or configuration (FIG. 1), and a bent, or contoured, position or configuration (FIG. 2). Segmented flexible linear shaped charge 10 includes a flexible explosive core 20 extending axially along a longitudinal axis 21, and a plurality of rigid housing segments or jackets 30 supported by explosive core 20. More particularly, explosive core 20 extends within housing segments 30 which are axially spaced apart from each other to define a plurality of intermediate portions or gaps 40.

Explosive core 20 of segmented flexible linear shaped charge 10 is comprised of a flexible material. For example, explosive core 20 may be formed of an explosive material mixed with a binder, such as a plastic bonded explosive (PBX). Illustratively, the binder may be comprised of elastomers and/or other polymers, such as rubber, silicone, polyethylene, or polypropylene. The inert materials of explosive core 20 have elastic properties which contribute to the flexible nature of explosive core 20. The flexible explosive core 20 may include various mixtures of an explosive solid, nitrocellulose, and/or acetyl tributyl citrate conforming to MIL-PRF-46676. Alternatively, explosive core 20 may include a generally brittle explosive material received by a flexible sleeve comprised of a polymeric inert material. Illustratively, core 20 is capable of pivotal or rotational movement about longitudinal axis 21, as well as about a first transverse axis 22 and a second transverse axis 23, both of which are orthogonal to longitudinal axis 21 (i.e., providing three degrees of freedom).

The explosive force of segmented flexible linear shaped charge 10 increases as the ratio of explosive material to inert material in explosive core 20 increases. The explosive load of explosive core 20 is directly related to the amount of explosive material present in explosive core 20 and is based upon the desired application of segmented flexible linear shaped charge 10. Illustrative explosive core 20 includes an explosive load of between 2,000 and 4,000 grains per foot.

Figure 3:
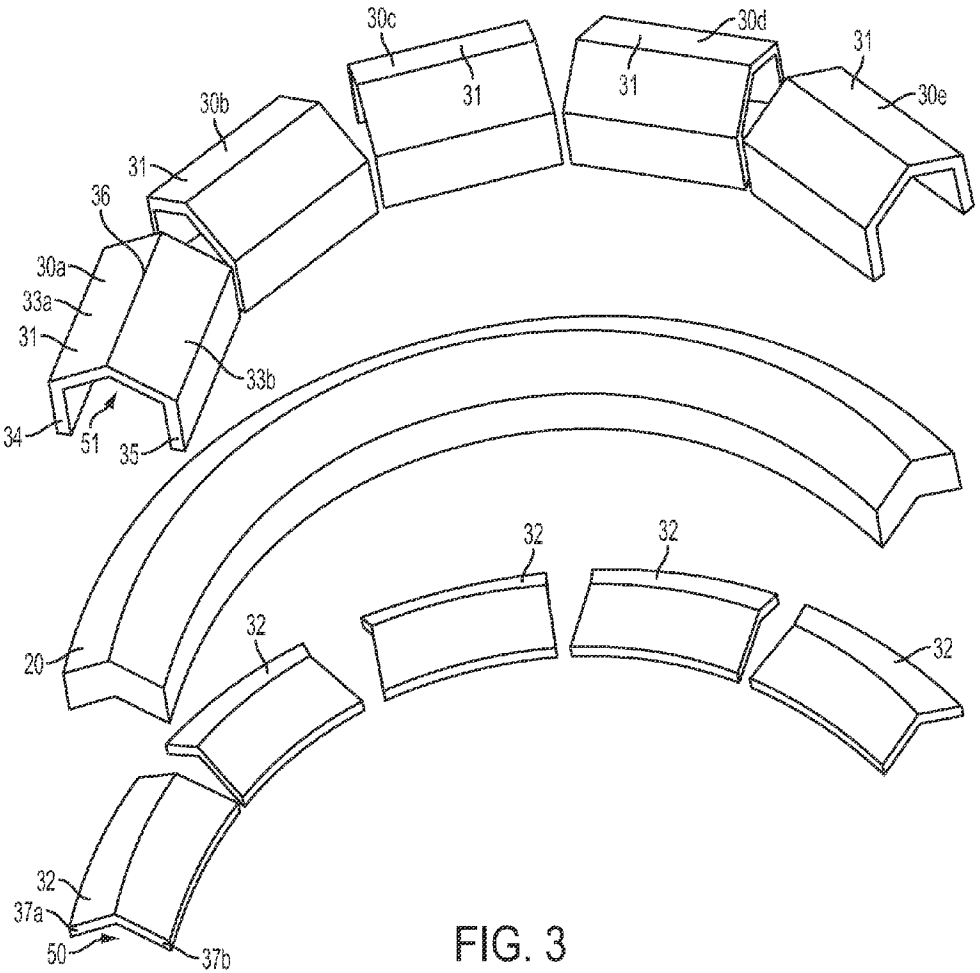
FIG. 3 is an exploded perspective view of the linear shaped charge of FIG. 2.

Referring to FIG. 3, a plurality of axially spaced housing segments or jackets 30*a*, 30*b*, 30*c*, 30*d*, and 30*e* are shown supported by explosive core 20. Housing segments 30 may be coupled to explosive core 20 by adhesive or mechanical couplers (e.g., snap fittings). Housing segments 30 may be formed after being coupled to explosive core 20 or independently of explosive core 20. For example, an elongated, single housing jacket first may be coupled to explosive core 20 and individual housing segments 30*a*, 30*b*, 30*c*, 30*d*, and 30*e* may be subsequently formed by removing, or cutting, portions of the elongated jacket to define individual housing segments 30*a*, 30*b*, 30*c*, 30*d*, and 30*e* and intermediate portions 40. Alternatively, housing segments 30*a*, 30*b*, 30*c*, 30*d*, and 30*e* may be individually formed prior to coupling with explosive core 20. As such, housing segments 30*a*, 30*b*, 30*c*, 30*d*, and 30*e* then slide along explosive core 20 and are retained thereon with conventional means, such as adhesives, couplers, or an interference fit. Additionally, the walls of housing segments 30 may include mechanical couplers to assemble the walls of housing segments 30 around explosive core 20. As such, the walls of housing segments 30 may fit together to form an enclosure around explosive core 20.

Housing segments 30 may be comprised of any suitable rigid material, such as a polymer, ceramic, or metal. Illustratively, housing segments 30 are comprised of extruded or stamped copper. Unlike explosive core 20, housing segments 30 are substantially rigid and generally incapable of independent movement in multiple directions. Instead, housing segments 30 move with explosive core 20, rather than independently from explosive core 20. In other words, the explosive core 20 has a Young's modulus (stiffness or rigidity) less than that of the housing segments 30.

Figure 4:
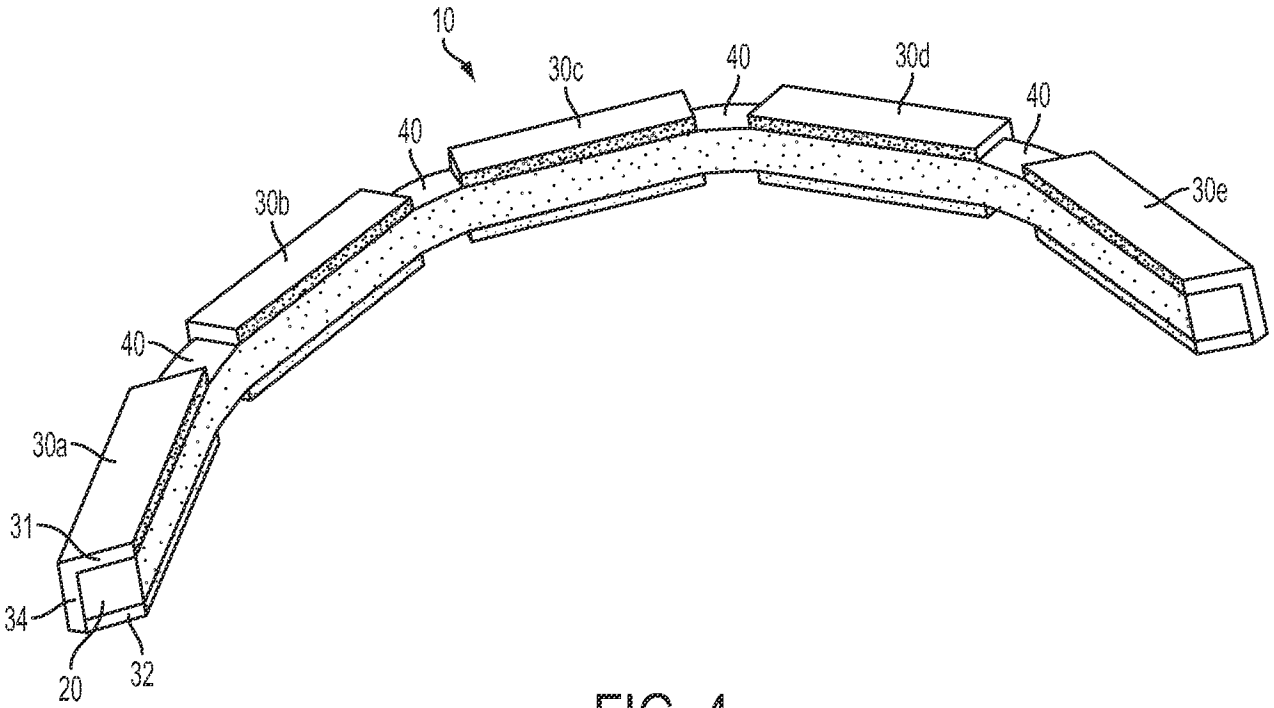
FIG. 4 is a cross-sectional view through a center axis of the linear shaped charge of FIG. 2.

Referring to FIGS. 3 and 4, housing segments 30 each include an upper wall 31, a lower wall 32, and opposing side walls 34, 35. Side walls 34, 35 are coupled to upper wall 31 and lower wall 32 to form a rigid enclosure. Upper wall 31, lower wall 32, and side walls 34, 35 each illustratively have a thickness of at least 0.0625 inches, however, the thickness may vary, depending on the explosive load of explosive core 20 and the desired effect of segmented flexible linear shaped charge 10. Upper wall 31 includes upper angled portions 33*a*, 33*b* angled downwardly relative to each other and meeting at a peak 36. Lower wall 32 includes lower angled portions 37*a*, 37*b* angled downwardly relative to each other and meeting at a peak 39. Lower wall 32 may be comprised of a material that is denser or harder than the material comprising upper wall 31 and side walls 34, 35 in certain applications to facilitate cutting efficiency. However, lower wall 32 is illustratively comprised of the same material as upper walls 31 and side walls 34, 35 ease of manufacturing. Side wall 34 is coupled to upper angled portion 33*a* and lower angled portion 37*a*, while side wall 35 is coupled to upper angled portion 33*b* and lower angled portion 37*b*. Explosive core 20 extends within housing segments 30 and is juxtaposed with walls 31, 32, 34, and 35.

Figure 5:
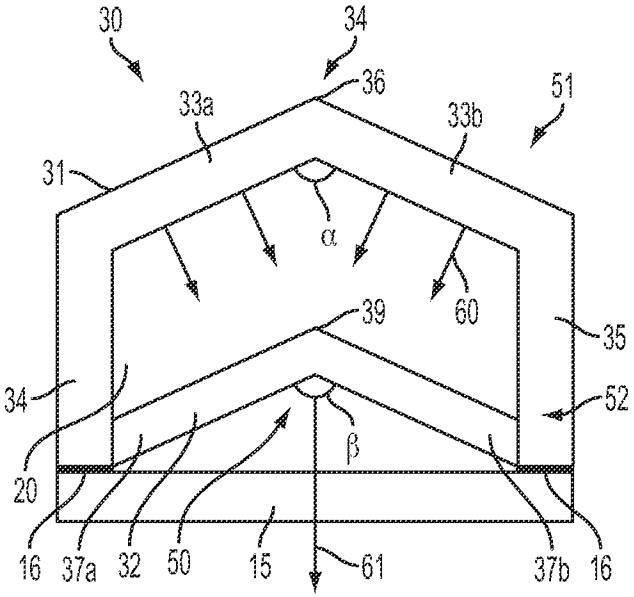
FIG. 5 is a diagrammatic view of the segmented flexible linear shaped charge of FIG. 2 upon detonation producing a cutting slug.

With reference to FIG. 5, peak 36 of each housing segment 30 is provided in the center of upper wall 31, wherein upper angled portions 33*a*, 33*b* define an angle $\alpha$ and a chevron 51 in cross-section. Similarly, peak 39 is provided in the center of lower wall 32, wherein lower angled portions 37*a*, 37*b* define an angle $\beta$ and a chevron 52 in cross-section. As such, each of housing segments 30, in cross-section, defines a pair of parallel, spaced apart upper and lower chevrons 51 and 52. Angles $\alpha$ and $\beta$ may extend between 70-120°. Alternatively, housing segments 30 may define other configurations in cross-section, such as a circular cross-section. When housing segments 30 are coupled to explosive core 20, illustrative segmented flexible linear shaped charge 10 is approximately 1.5 inches in width and approximately 1.5 inches in height. However, the width and height of segmented flexible linear shaped charge 10 may vary, depending on the desired application and required explosive force.

With further reference to FIGS. 2 and 5, when lower wall 32 is coupled to a target 15, chevron 52 of lower wall 32 defines a stand-off cavity 50. More particularly, lower angled portions 37*a*, 37*b* of lower wall 32 define stand-off cavity 50 adjacent to target 15. In other words, stand-off cavity 50 is illustratively provided intermediate lower wall 32 of housing segments 30 and target 15. Stand-off cavity 50 provides a necessary distance in which gas particles and at least lower wall 32 of housing segments 30 may accelerate upon detonation and before contacting target 15.

According to the well-known Munroe Effect, during an explosion from a linear shaped charge, it is desirable for the resultant gas particles and components of the linear shaped charge to reach an effective acceleration rate in order to penetrate a target. The Munroe Effect explains the resulting indentation or penetration of a target at a contact point between an explosive charge and the surface of the target. The Munroe Effect suggests that it may be more effective to focus explosive energy toward a cavity before contacting the target. Within the cavity, the explosive energy is delayed from reaching the target surface and may be able to reach a greater acceleration rate before penetrating the target. Therefore, the explosive force on the target may be greater and may result in greater penetration depth into the target.

Chevrons 51, 52 of housing segments 30 may facilitate the Munroe Effect. As is shown in FIG. 5, the explosive energy from core 20 of flexible linear shaped charge 10 is released perpendicular to upper angled portions 33*a*, 33*b*. Explosive energy travels through housing segments 30 as shock waves 60 (shown as arrows in FIG. 5). Chevron 51 of upper wall 31 provides an effective shape to reflect and direct shock waves 60 inwardly and downwardly toward lower wall 32. Explosive energy enters stand-off cavity 50 as shock waves 60 which are focused toward target 15. Lower wall 32 of flexible linear shaped charge 10 illustratively forms a cutting slug 61 (shown as a vertical arrow in FIG. 5) during the explosion. The cutting slug 61 is formed by a plurality of high speed, focused particles defined by the explosive core 20 and lower wall 32.

Figure 6:
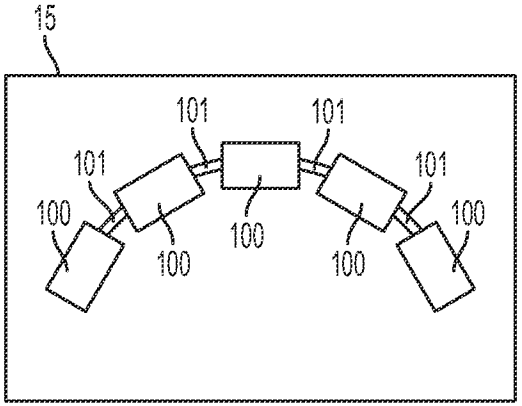
FIG. 6 is a top plan view of a target following detonation of the linear shaped charge of FIG. 2.

With reference to FIGS. 5 and 6, the momentum of shock waves 60 may be conserved within housing segments 30 because upper wall 31 of housing segments 30 serves to redirect any reflected shock waves 60 from explosive core 20 generally toward peak 39 of lower wall 32. Differential velocities of shock waves 60 and the force of the explosion crush lower wall 32 of housing segments 30, forcing lower wall 32 to collapse onto itself and accelerate, elongate, and partially invert to form cutting slug 61. Cutting slug 61 is directed towards target 15 and, upon reaching the surface of target 15 at a high speed, penetrates target 15 in a focused, linear configuration at first cutting effects 100 (FIG. 6).

Referring to FIG. 6, first cutting effects 100 include the same general contour in which housing segments 30*a*, 30*b*, 30*c*, 30*d*, and 30*e* (FIG. 2) were positioned on target 15. Additionally, a plurality of second cutting effects 101 include the same general contour in which intermediate portions 40 (FIG. 2) were positioned on target 15. According to the Munroe Effect, first cutting effects 100 are formed at the location of each of housing segments 30 because chevrons 51, 52 focus the explosive energy toward stand-off cavity 50 and into target 15. Stand-off cavity 50 provides the distance required for an effective acceleration rate for penetration, thereby increasing the force of cutting slug 61 into target 15. First cutting effects 100 have a greater volume (e.g., depth and/or width) than second cutting effects 101 because of this focused explosive force. However, it is desirable to minimize the size of second cutting effects 101 and produce a substantially continuous cut, formed by first cutting effects 100, in target 15. As such, housing segments 30*a*, 30*b*, 30*c*, 30*d*, and 30*e* are positioned sufficiently near adjacent housing segments 30 to reduce the size of second cutting effects 101, thereby producing a substantially continuous cut in target 15. However, to maintain the flexibility of flexible linear shaped charge 10, housing segments 30 are not juxtaposed end-to-end along core 20.

Referring further to FIGS. 1 and 2, housing segments 30*a*, 30*b*, 30*c*, 30*d*, and 30*e* are axially spaced along longitudinal axis 21 of core 20 and intermediate portions 40 are provided between adjacent housing segments 30. Intermediate portions 40 facilitate the movement of core 20 about longitudinal axis 21. Additionally, intermediate portions 40 provide flexibility to core 20 about first transverse axis 22 extending perpendicular to longitudinal axis 21, and second transverse axis 23 extending perpendicular to longitudinal axis 21 and first transverse axis 22. In other words, intermediate portions 40 permit pivotal or rotational movement of core 20 about a plurality of axes. Furthermore, a portion of segmented flexible linear shaped charge 10 may be separated, or severed, with a knife, fixed blade, or razor blade within any of intermediate portions 40. In this way, segmented flexible linear shaped charge 10 may be cut to a desired length, making it adaptable for a variety of applications.

FIG. 1 exemplifies a linear configuration of flexible linear shaped charge 10, whereas FIG. 2 exemplifies a bent, or contoured, configuration of flexible linear shaped charge 10. As such, flexible linear shaped charge 10 may be shaped in a desired contour because flexible linear shaped charge 10 has at least three degrees of freedom. The three degrees of freedom include a first degree of freedom defined as rotation about longitudinal axis 21, a second degree of freedom defined as rotation about first transverse axis 22, and a third degree freedom defined as rotation about second transverse axis 23. As shown in FIG. 1, first transverse axis 22 extends in a substantially vertical direction perpendicular to longitudinal axis 21, while second transverse axis 23 extends in a substantially horizontal direction perpendicular to axes 21 and 22. Housing segments 30 and intermediate portions 40 permit movement of core 20, and therefore, flexible linear shaped charge 10, about longitudinal axis 21, first transverse axis 22, and second transverse axis 23.

Referring to FIGS. 2 and 5, flexible linear shaped charge 10 is illustratively coupled to target 15. Target 15 may have variable surfaces and shapes. For example, target 15 may be a pipe, a door, a metal plate, a boulder or other earthen surface, a bridge, studs, prop sticks, or a building. Flexible linear shaped charge 10 may be secured to target 15 using couplers 16. Couplers 16 may be conventional and well-known (e.g., adhesives, double-sided tape, magnets, fasteners, etc.).

Figure 7:
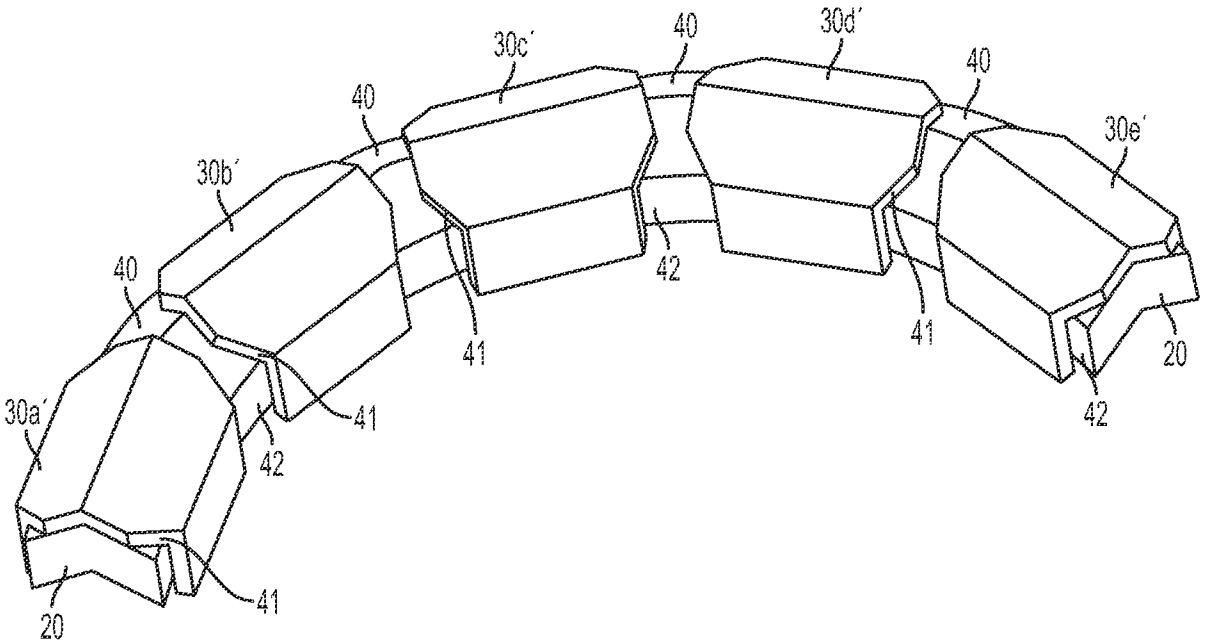
FIG. 7 is a front perspective view of an alternative embodiment linear shaped charge having chamfered edges and in a contoured configuration.

With reference to FIG. 7, an alternative embodiment of housing segments 30 is shown. The alternative embodiment includes chamfered edges 41 along outer edges of side walls 34, 35. Chamfered edges 41 create clearance portions 42 along intermediate portions 40 and extend along opposing outer edges of adjacent housing segments 30. Chamfered edges 41 and resultant clearance portions 42 allow for greater flexibility of core 20 by permitting tighter bends (i.e., a smaller curvature radius) because potential interference between opposing ends of housing segments 30 is reduced.

With reference to FIG. 2, in preparation for detonating segmented flexible linear shaped charge 10, side walls 34, 35 of housing segments 30 may be coupled with target 15 using couplers 16. For example, the coupling of side walls 34, 35 to target 15 may be achieved using adhesive tape or magnets. Couplers 16 may be positioned intermediate the bottom of side walls 34, 35 and target 15 proximate lower wall 32. Prior to coupling segmented flexible linear shaped charge 10 to target 15, segmented flexible linear shaped charge 10 is flexed, or contoured, to a desired shape. In this way, segmented flexible linear shaped charge 10 may be adapted to a variety of applications.

Segmented flexible linear shaped charge 10 may be manufactured by forming core 20 and housing segments 30 through conventional means. For example, core 20 may be extruded or injection molded. Explosive material is embedded, or received, within core 20 during the manufacturing process. Housing segments 30 may be individually injection molded, compression molded, stamped, or machined and then received on explosive core 20. Alternatively, housing segments 30 may be formed by removing portions of a single, elongated jacket coupled to explosive core 20 to define individual housing segments 30*a*, 30*b*, 30*c*, 30*d*, and 30*e* and intermediate portions 40. The elongated, single jacket also may be injection molded, compression molded, stamped, or machined. Adhesive or mechanical couplers may further be used to retain housing segments 30 on explosive core 20.

Segmented flexible linear shaped charge 10 may be operably coupled to a detonation device (not shown), such as a conventional detonation cord or remote detonation means.

In use, segmented flexible linear shaped charge 10 is located in proximity to the penetration surface of target 15. Segmented flexible linear shaped charge 10 may be cut to a desired length with a knife, a fixed blade, or a razor blade within any of intermediate portions 40. Segmented flexible linear shaped charge 10 may then be shaped to a particular configuration, depending on the desired application. For example, flexible linear shaped charge 10 may be bent into a specific shape on target 15, wrapped around target 15, or positioned linearly on target 15. Flexible linear shaped charge 10 may be contoured and shaped by hand because of the flexible nature of segmented flexible linear shaped charge 10. Housing segments 30 may be coupled to target 15 by applying couplers 16, such as adhesive, double-sided tape, or magnets to housing segments 30, target 15, or both. Once coupled to target 15, segmented flexible linear shaped charge 10 may be operably coupled to a detonation device and subsequently detonated, thereby causing an explosive force resulting in penetration of target 15. Segmented flexible linear shaped charge 10 is effective for cutting a variety of materials, such as steel having a thickness of at least 1.0 inch.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A segmented flexible linear shaped charge comprising:

a flexible explosive core extending axially along a longitudinal axis; and a plurality of axially spaced housing segments operably coupled to a target, each of the housing segments having a rigidity greater than that of the explosive core, the explosive core extending within the plurality of housing segments, and each of the housing segments including an upper wall, a lower wall, and opposing side walls connected to the upper wall and the lower wall, the lower wall including a first angled portion and a second angled portion coupled at an apex and defining a stand-off cavity, wherein upon detonation of the explosive core, the lower wall of the plurality of housing segments and the explosive core are configured to be focused into the target.

2. The segmented flexible linear shaped charge of claim 1, wherein the core is comprised of an elastomeric explosive.

3. The segmented flexible linear shaped charge of claim 1, wherein the core includes an explosive material, the explosive material including an explosive filler and a binder comprising a polymer, the explosive filler being coupled with the binder.

4. The segmented flexible linear shaped charge of claim 1, wherein the housing segments are comprised of at least one of a polymer and a ceramic.

5. The segmented flexible linear shaped charge of claim 1, wherein the housing segments are comprised of metal.

6. The segmented flexible linear shaped charge of claim 1, wherein the housing segments include at least one of a chevron cross-section and a circular cross-section.

7. The segmented flexible linear shaped charge of claim 6, wherein the upper wall includes first and second angled portions forming an upper chevron, and the lower wall includes first and second angled portions forming a lower chevron.

8. The segmented flexible linear shaped charge of claim 7, wherein the side walls include a thickness of at least 0.0625 inches, the upper wall includes a thickness of at least 0.0625 inches, the lower wall includes a thickness of at least 0.0625 inches, the upper chevron includes an angle of at least 70° between the angled portions of the upper wall, and the lower chevron includes an angle of at least 70° between the angled portions of the lower wall.

9. The segmented flexible linear shaped charge of claim 1, further comprising at least one clearance portion positioned between opposing ends of the side walls of adjacent housing segments and being angled inwardly from the opposing ends of the side walls, the clearance portions being configured to provide increased flexibility between adjacent housing segments.

10. The segmented flexible linear shaped charge of claim 1, wherein the core includes an explosive load of between 2,000 and 4,000 grains per foot.

11. The segmented flexible linear shaped charge of claim 1, wherein each of the housing segments are coupled to the core by at least one of a mechanical coupler and an adhesive.

12. A segmented flexible linear shaped charge comprising:

a flexible explosive core extending axially along a longitudinal axis;

a plurality of axially spaced, rigid housing segments, the core extending within the plurality of housing segments;

a coupler securing the housing segments to a target; and a plurality of intermediate portions extending between opposing ends of adjacent housing segments, wherein the segmented flexible linear shaped charge includes at least three degrees of freedom, including rotation about the longitudinal axis of the core, rotation about a first transverse axis extending perpendicular to the longitudinal axis, and rotation about a second transverse axis extending perpendicular to the longitudinal axis and the first transverse axis.

13. The segmented flexible linear shaped charge of claim 12, wherein the core is comprised of an elastomeric explosive.

14. The segmented flexible linear shaped charge of claim 12, wherein the core includes an explosive material, the explosive material including an explosive filler and a substrate comprising a polymer, the explosive filler being coupled with the substrate.

15. The segmented flexible linear shaped charge of claim 12, wherein the housing segments are comprised of at least one of a polymer and a ceramic.

16. The segmented flexible linear shaped charge of claim 12, wherein the housing segments are comprised of metal.

17. The segmented flexible linear shaped charge of claim 12, wherein the housing segments include at least one of a chevron cross-section and a circular cross-section.

18. The segmented flexible linear shaped charge of claim 12, wherein each of the housing segments includes an upper wall, a lower wall defining a stand-off cavity, and opposing side walls coupled to the upper wall and the lower wall.

19. The segmented flexible linear shaped charge of claim 18, wherein the upper wall includes first and second angled portions forming an upper chevron, and the lower wall includes first and second angled portions forming a lower chevron.

20. The segmented flexible linear shaped charge of claim 19, wherein the side walls include a thickness of at least 0.0625 inches, the upper wall includes a thickness of at least 0.0625 inches, the lower wall includes a thickness of at least 0.0625 inches, the upper chevron includes an angle of at least 70° between the angled portions of the upper wall, and the lower chevron includes an angle of at least 70° between the angled portions of the lower wall.

21. The segmented flexible linear shaped charge of claim 12, further comprising at least one clearance portion positioned between opposing ends of the side walls of adjacent housing segments and being angled inwardly from the opposing ends of the side walls, the clearance portions being configured to provide increased flexibility between adjacent housing segments.

22. The segmented flexible linear shaped charge of claim 12, wherein the core includes an explosive load of between 2,000 and 4,000 grains per foot.

23. The segmented flexible linear shaped charge of claim 12, wherein each of the housing segments are coupled to the core by at least one of a mechanical coupler and an adhesive.

* * * * *